US010018405B2

(12) United States Patent
Abrahamson

(10) Patent No.: US 10,018,405 B2
(45) Date of Patent: Jul. 10, 2018

(54) REFRIGERATOR LOCKING SYSTEM

(71) Applicant: Carl Kent Abrahamson, Edmond, OK (US)

(72) Inventor: Carl Kent Abrahamson, Edmond, OK (US)

( * ) Notice: Subject to any disclaimer, the term of this patent is extended or adjusted under 35 U.S.C. 154(b) by 0 days.

(21) Appl. No.: 15/365,380

(22) Filed: Nov. 30, 2016

(65) Prior Publication Data

US 2017/0219271 A1 Aug. 3, 2017

Related U.S. Application Data

(60) Provisional application No. 62/288,585, filed on Jan. 29, 2016.

(51) Int. Cl.

| | |
|---|---|
| ***F25D 23/02*** | (2006.01) |
| ***E05C 19/00*** | (2006.01) |
| ***E05C 19/18*** | (2006.01) |
| ***E05B 65/00*** | (2006.01) |
| ***E05C 17/00*** | (2006.01) |
| ***E05B 47/00*** | (2006.01) |
| ***E05C 7/00*** | (2006.01) |

(Continued)

(52) U.S. Cl.

CPC ..... *F25D 23/028* (2013.01); *E05B 47/00* (2013.01); *E05B 65/0014* (2013.01); *E05C 7/00* (2013.01); *E05C 17/00* (2013.01); *E05C 19/003* (2013.01); *F25D 29/006* (2013.01); *E05B 2047/0068* (2013.01); *F25D 25/025* (2013.01); *F25D 2323/024* (2013.01); *F25D 2400/06* (2013.01); *F25D 2700/02* (2013.01)

(58) Field of Classification Search

CPC ... Y10T 292/71; Y10T 292/73; Y10T 292/20; E05C 19/003; E05C 19/007; E05C 19/18; E05C 19/182; E05C 19/184; E05C 19/186; E05C 19/188; E05C 7/04; E05C 7/00; E05C 17/00; F25D 29/006; F25D 23/028; F25D 2700/02; F25D 25/025; F25D 2323/024; F25D 2400/06; E05B 65/0014; E05B 65/0042; E05B 65/00; E05B 65/0003; E05B 65/005; E05B 65/08; E05B 65/088; E05B 65/0894; E05B 47/00; E05B 2047/0068; Y10S 292/71

USPC ..... 292/288, 289, DIG. 71, 342, 343

See application file for complete search history.

(56) References Cited

U.S. PATENT DOCUMENTS 2,373,783 A * 4/1945 Schlifer ..... E05C 19/003 292/207

3,437,365 A * 4/1969 Zadanoff ..... E05B 65/0014 292/202

(Continued)

*Primary Examiner* — Hiwot E Tefera

(57) ABSTRACT

A refrigerator locking system is used to secure the doors of a refrigerator in closed or open positions. The system includes at least one anchor bar, a locking bracket, a door block and a refrigerator. The refrigerator includes a frame, at least one refrigerator door and a freezer door. The anchor bar is mounted to the frame in between the refrigerator door and the freezer door. The locking bracket is connected adjacent to the frame and is engaged with to the door block to secure the refrigerator door and the freezer door. The door block can be used to press the refrigerator door and the freezer door against the frame, keeping the refrigerator closed. Alternatively, the door block can be positioned in between the frame and both the refrigerator door and the freezer door to keep the refrigerator open.

10 Claims, 12 Drawing Sheets

(51) Int. Cl.
*F25D 29/00* (2006.01)
*F25D 25/02* (2006.01)

(56) References Cited

U.S. PATENT DOCUMENTS 4,648,637 A * 3/1987 Walter ..... E05C 3/14 292/128
5,114,194 A * 5/1992 Toifl ..... E05B 65/0014 292/106
5,209,533 A * 5/1993 Menard ..... E05C 19/18 292/258
5,265,921 A * 11/1993 Nikitas ..... E05C 19/18 292/145
5,340,172 A * 8/1994 Sweet ..... E05C 19/003 292/259 R
5,358,293 A * 10/1994 Bradley, Jr. ..... E05C 19/18 292/269
5,388,876 A * 2/1995 Saincome ..... E05C 3/041 292/218
5,419,165 A * 5/1995 Perkins ..... E05B 67/383 292/258
5,669,641 A * 9/1997 Jeansonne ..... E05C 19/003 292/259 R
7,226,093 B1 * 6/2007 Stailey ..... E05C 19/003 292/259 R
7,331,617 B2 * 2/2008 Johnson ..... E05B 17/2019 16/82
7,798,542 B2 * 9/2010 Frazier ..... E05C 7/04 292/258
8,313,128 B2 * 11/2012 Belyea ..... E05B 13/00 292/258
8,544,899 B2 * 10/2013 Hertrich ..... E05B 65/0014 292/195
9,163,441 B1 * 10/2015 Taylor, III ..... E05C 19/003
2010/0037664 A1 * 2/2010 Pitisethakarn ..... E05L 367/383 70/56
2011/0153739 A1 * 6/2011 McCoy ..... H01R 13/6683 709/204
2014/0259958 A1 * 9/2014 Rumble ..... F25D 23/028 49/506

* cited by examiner

REFRIGERATOR LOCKING SYSTEM

The current application claims a priority to the U.S. Provisional Patent application Ser. No. 62/288,585 filed on Jan. 29, 2016.

FIELD OF THE INVENTION

The present invention relates generally to systems for locking a refrigerator. More specifically, the present invention relates to a system which can be used to secure the doors of a refrigerator in either a closed position or an open position.

BACKGROUND OF THE INVENTION

Refrigerators are commonly used to maintain a cold internal temperature which helps to prevent foods and beverages from spoiling. While closed, refrigerators are effective at accomplishing this task. However, if one or more doors from the refrigerator are left ajar, heat may be permitted to enter the refrigerator, warming the internal temperature. As heat enters, the refrigerator must work harder to expel heat in order to keep foods cold. If gone unnoticed, an open door can lead to the spoiling of foods and vast amounts of wasted energy. When a refrigerator is unplugged, keeping the refrigerator doors open helps to prevent mold from growing within the refrigerator. Unfortunately, without additional hardware, it can be difficult to prevent the doors of a refrigerator from closing, especially when transporting the refrigerator.

Accordingly, there is a present need for a system which can be used to secure the doors of a refrigerator in either an open position or a closed position. The present invention is a refrigerator locking system which can be used to secure multiple doors of a refrigerator at once. The system uses a door block which can be used to keep the refrigerator doors closed to prevent unauthorized access or to prevent foods from falling out of the refrigerator. This can be especially useful for refrigerators that are installed within campers or recreational vehicles which may be subjected to unpredictable movements. The door block may also be positioned in between the doors and the refrigerator to prevent the doors from closing.

DETAILED DESCRIPTION OF THE INVENTION

All illustrations of the drawings are for the purpose of describing selected versions of the present invention and are not intended to limit the scope of the present invention.

Figure 1:
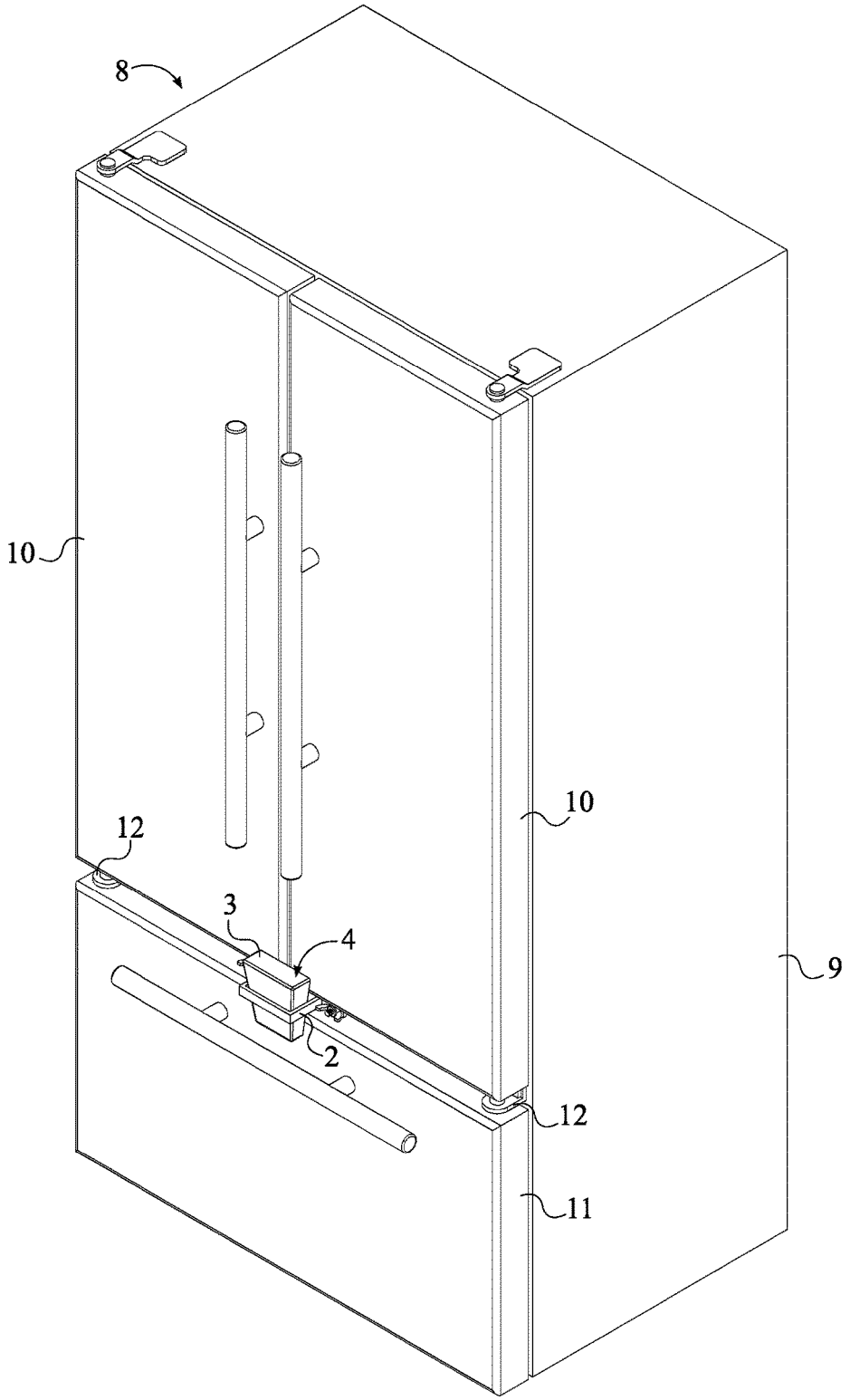
FIG. 1 is a front perspective view of the present invention.
Figure 2:
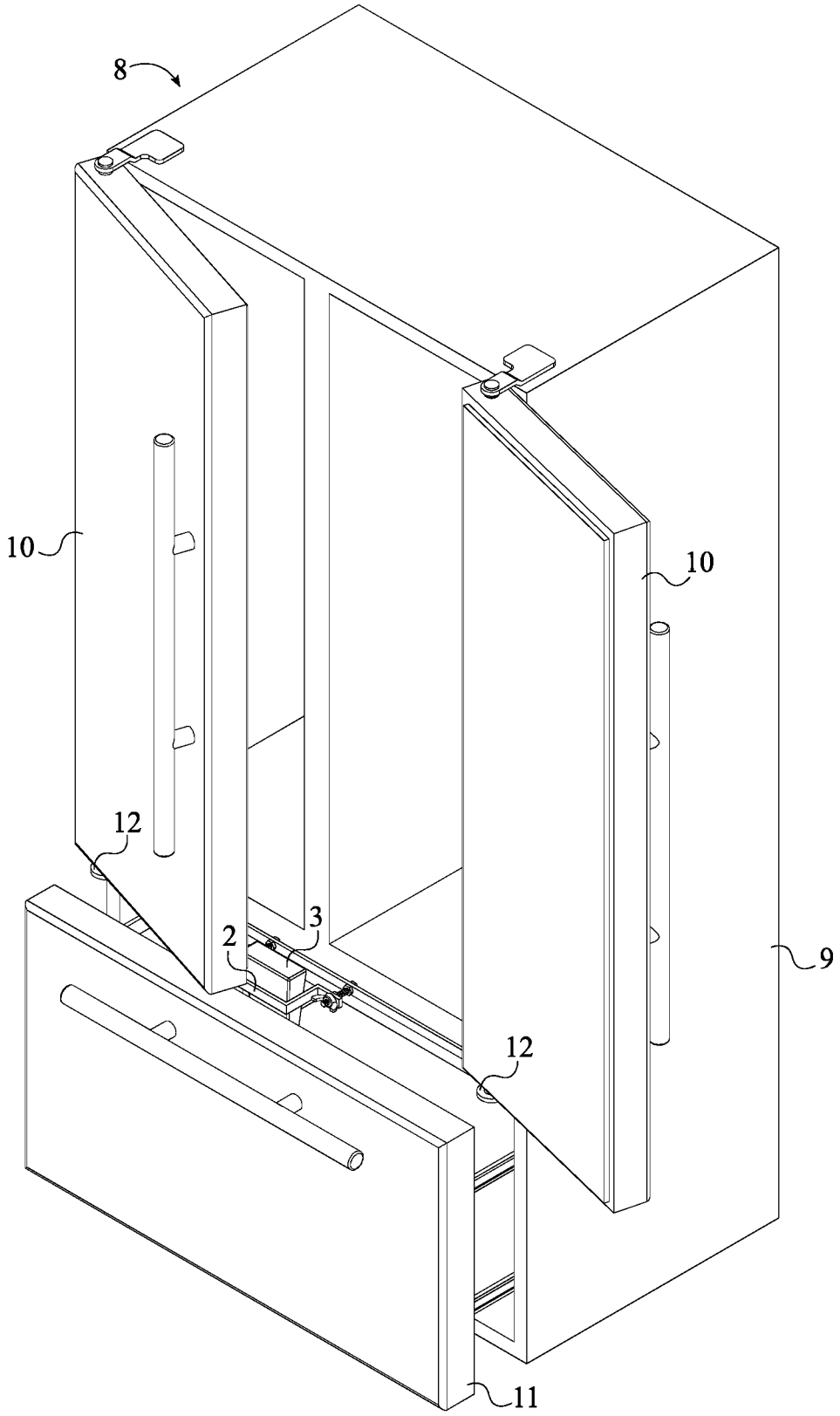
FIG. 2 is a front perspective view of the present invention with the at least one refrigerator door and the freezer door open.
Figure 3:
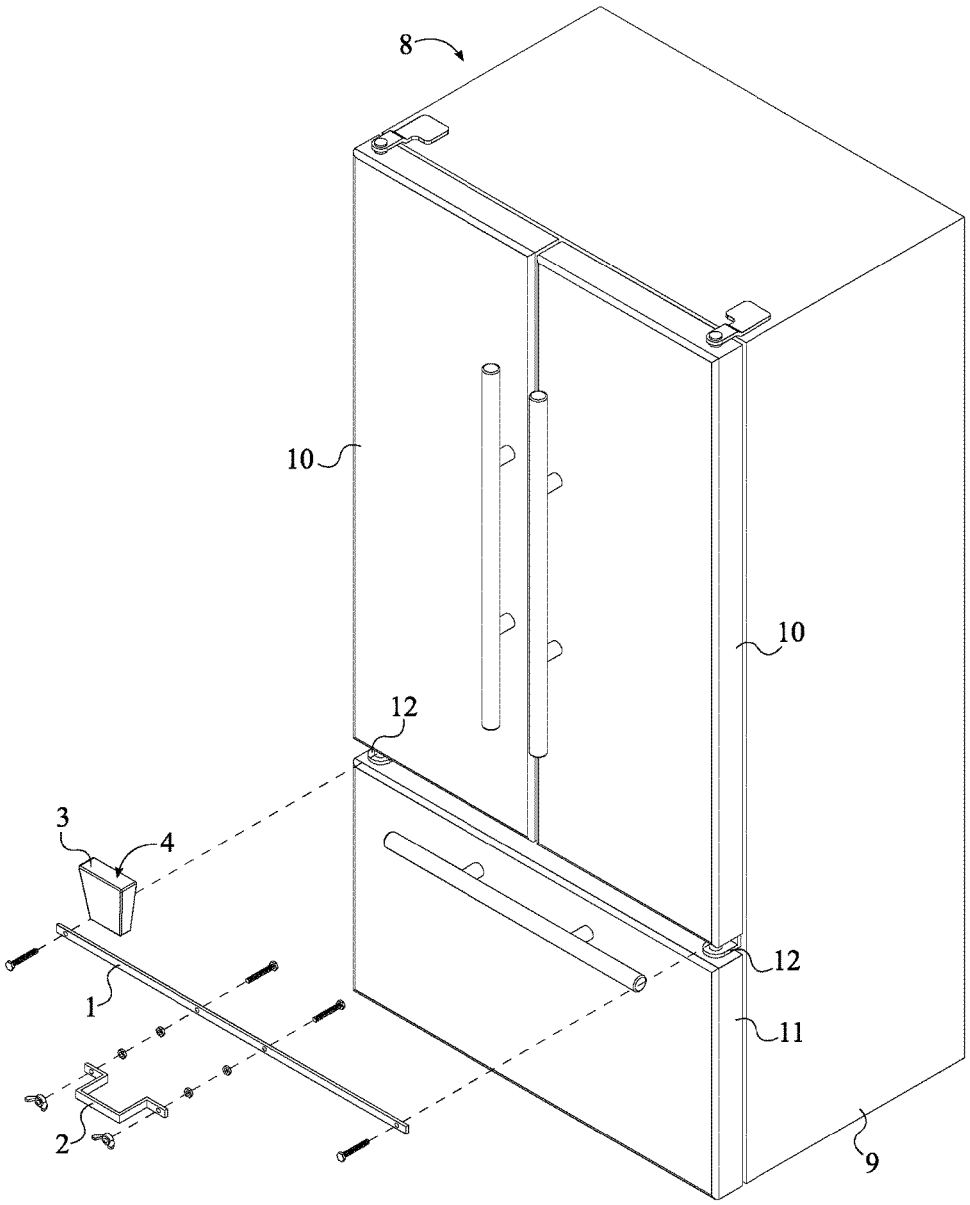
FIG. 3 is an exploded front perspective view of the present invention.

With reference to FIGS. 1-3, the present invention is a refrigerator locking system used for securing the doors of a refrigerator in either closed or open positions. The present invention comprises at least one anchor bar 1, a locking bracket 2, a door block 3, and a refrigerator 8. Like a standard refrigerator, the refrigerator 8 is used to maintain a cold temperature in order to prevent foods from spoiling. The refrigerator 8 comprises a frame 9, at least one refrigerator door 10, and a freezer door 11. The frame 9 is used to hold various types of foods. The refrigerator door 10 is hingedly mounted to the frame 9. The freezer door 11 is mounted to the frame 9, adjacent to the refrigerator door 10. While closed, the refrigerator door 10 and the freezer door 11 are used to prevent heat from entering into the frame 9. By opening the refrigerator door 10 or the freezer door 11, foods may be put into or taken from the frame 9. The arrangement of the refrigerator door 10, the freezer door 11, and the frame 9 may be different for varying models of refrigerators 8. For example, the refrigerator 8 may have a French door design, a top freezer design, a bottom freezer design, or various other designs. The anchor bar 1 is mounted adjacent to the frame 9 in between the refrigerator door 10 and the freezer door 11. The anchor bar 1 is used as a stable base for mounting the locking bracket 2 to the refrigerator 8. The locking bracket 2 is connected adjacent to the anchor bar 1, opposite to the refrigerator 8. The locking bracket 2 is used to secure the door block 3 to the refrigerator 8. When using the present invention, the locking bracket 2 is engaged by the door block 3. By doing so, the door block 3 is pressed against the refrigerator door 10 and the freezer door 11. Depending on the needs of the user, this may be done to either lock the refrigerator door 10 and the freezer door 11 closed, or prevent the refrigerator door 10 and the freezer door 11 from opening.

In reference to FIG. 1, when the user wishes to lock the refrigerator door 10 closed, the refrigerator door 10 is pressed against the frame 9 by the door block 3. Similarly, in order to lock the freezer door 11 closed, the freezer door 11 is pressed against the frame 9 by the door block 3. This is useful if the refrigerator 8 is located in a camper, a boat, or some other vehicle. Further, locking the refrigerator 8 may be useful for preventing children from accessing foods without permission.

In reference to FIG. 2, when the user wishes to keep the refrigerator door 10 open, the door block 3 is positioned in between the refrigerator door 10 and the frame 9. Similarly, in order to keep the freezer door 11 open, the door block 3 is positioned in between the freezer door 11 and the frame 9. This arrangement can be useful for preventing mold from growing inside the refrigerator 8. If the user empties and unplugs the refrigerator 8, the door block 3 can be used to prop the refrigerator door 10 and the freezer door 11 open in order to permit air to flow into the refrigerator 8.

In reference to FIG. 1 and FIG. 3, the present invention further comprises a hinge bracket 12. The hinge bracket 12 is positioned in between the refrigerator door 10 and the freezer door 11 and is integrated into the hinged connection between the frame 9 and the refrigerator door 10. Depending on the model of the refrigerator 8, the hinge bracket 12 may also be used to mount the freezer door 11 onto the frame 9. The anchor bar 1 is terminally mounted to the hinge bracket 12. This arrangement allows the anchor bar 1 to be fixed to the refrigerator 8 without requiring modification to the refrigerator 8.

The present invention further comprises at least one mounting feature 13. The mounting feature 13 is used to secure the anchor bar 1 to the hinge bracket 12. The mounting feature 13 is laterally integrated through the anchor bar 1 and the hinge bracket 12. In the preferred embodiment of the present invention, the mounting feature 13 comprises a mounting bolt which traverses through the anchor bar 1 and the hinge bracket 12 and into the frame 9. In order for the mounting feature 13 to traverse through the anchor bar 1, one or more holes may be drilled through the anchor bar 1. The holes may be drilled by the manufacturer of the anchor bar 1 or may be drilled by the user to match the dimensions of the refrigerator 8.

Figure 9:
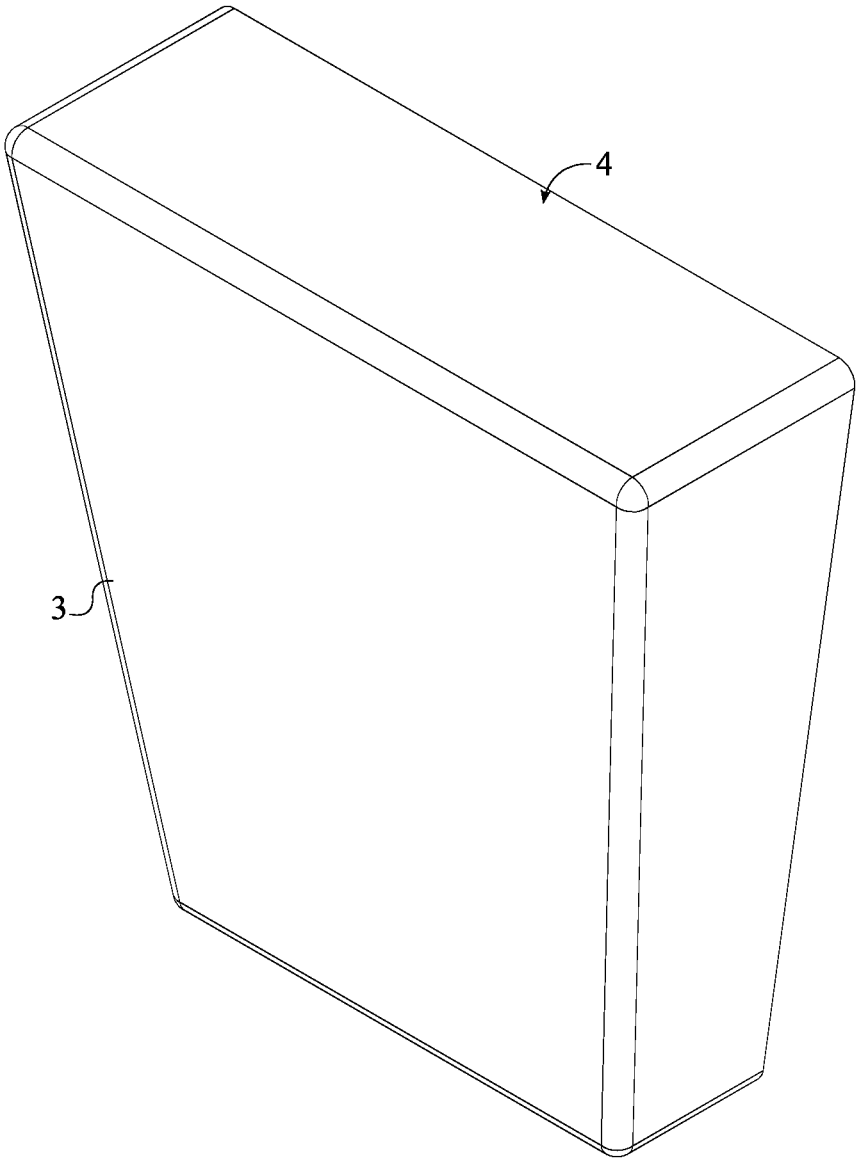
FIG. 9 is a front perspective view of a first embodiment of the door block, wherein the first embodiment of the door block is tapered.
Figure 10:
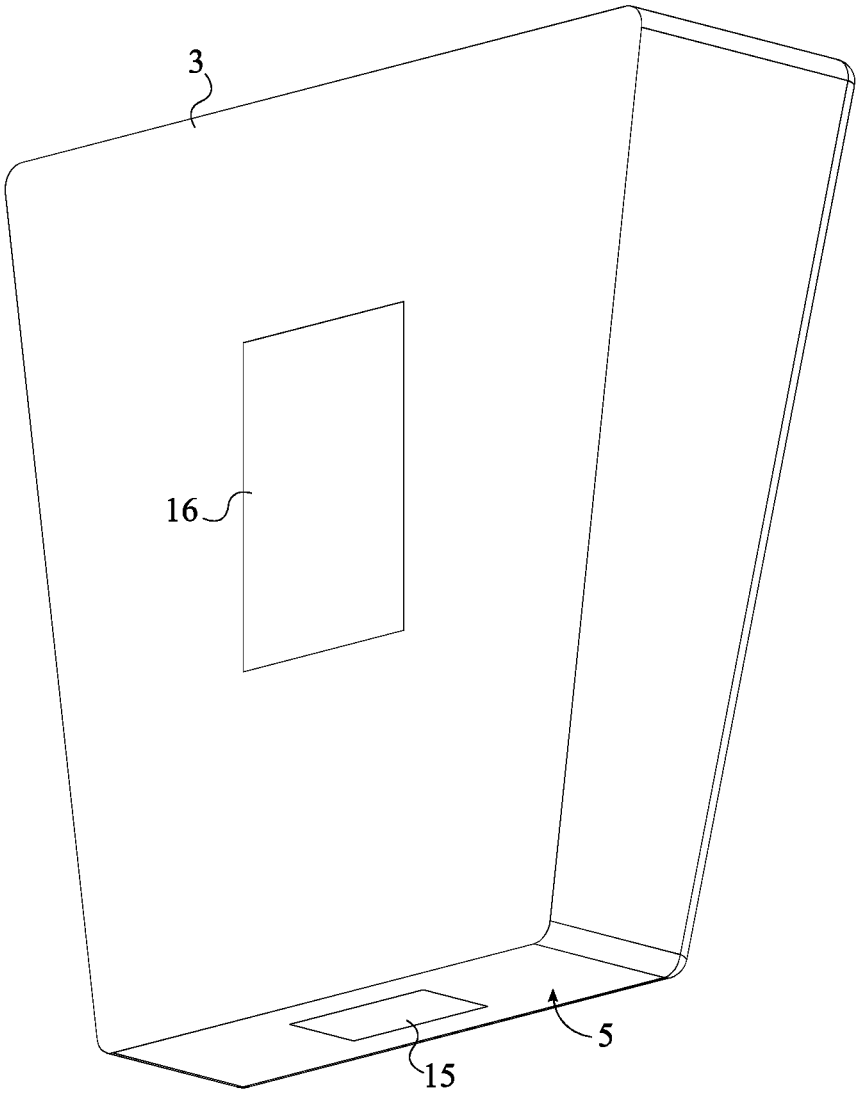
FIG. 10 is a rear bottom perspective of the first embodiment of the door block.

In reference to FIGS. 9-10, the shape of the door block 3 may vary for differing models of refrigerators 8. In a first embodiment of the door block 3, the door block 3 comprises a first end 4 and a second end 5. In this embodiment, the door block 3 tapers from the first end 4 to the second end 5. This allows the second end 5 to be engaged with the locking bracket 2. The width of the door block 3 near the first end 4 is too large to fit in between the refrigerator 8 and the locking bracket 2. This arrangement allows the door block 3 to be secured to the locking bracket 2.

Figure 4:
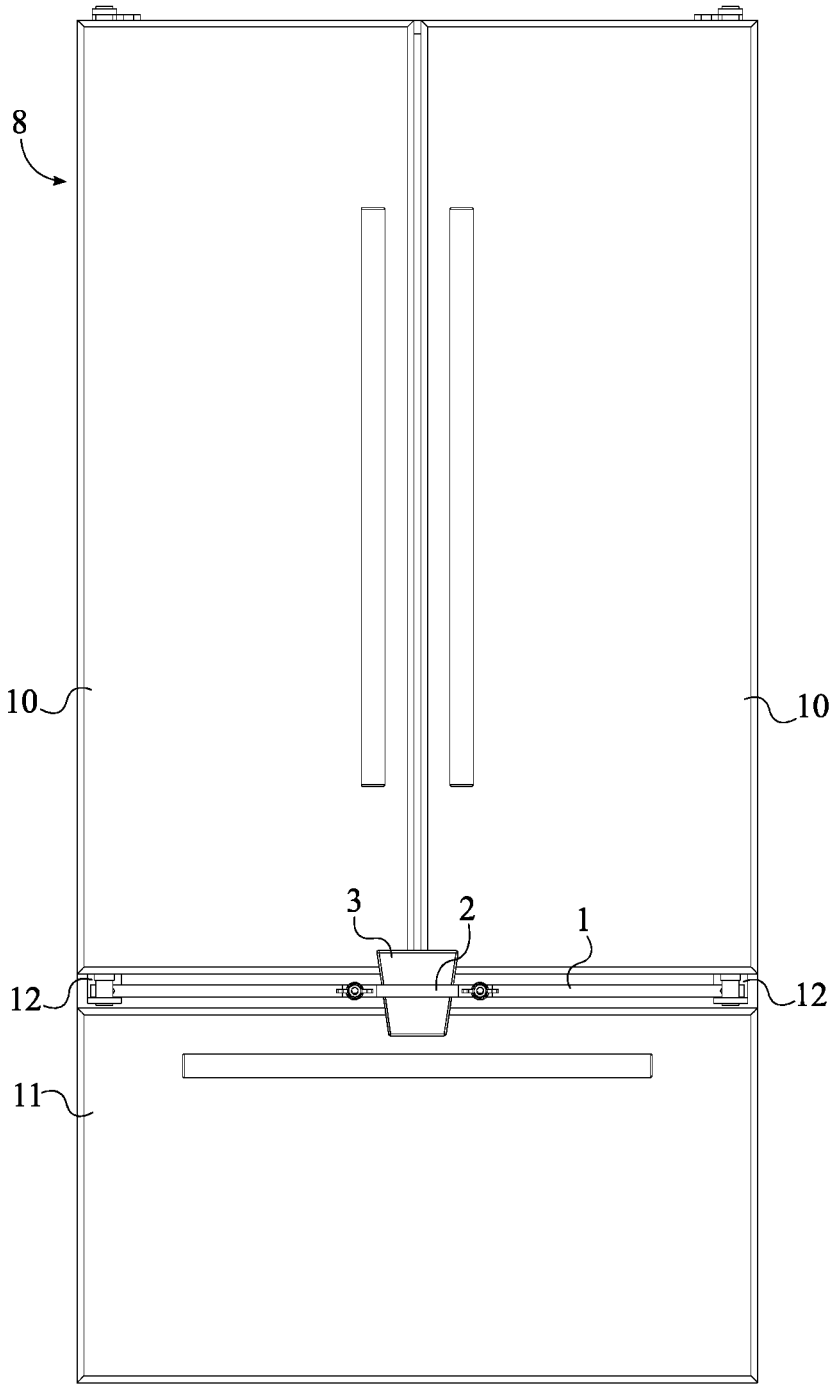
FIG. 4 is a front view of the present invention.
Figure 5:
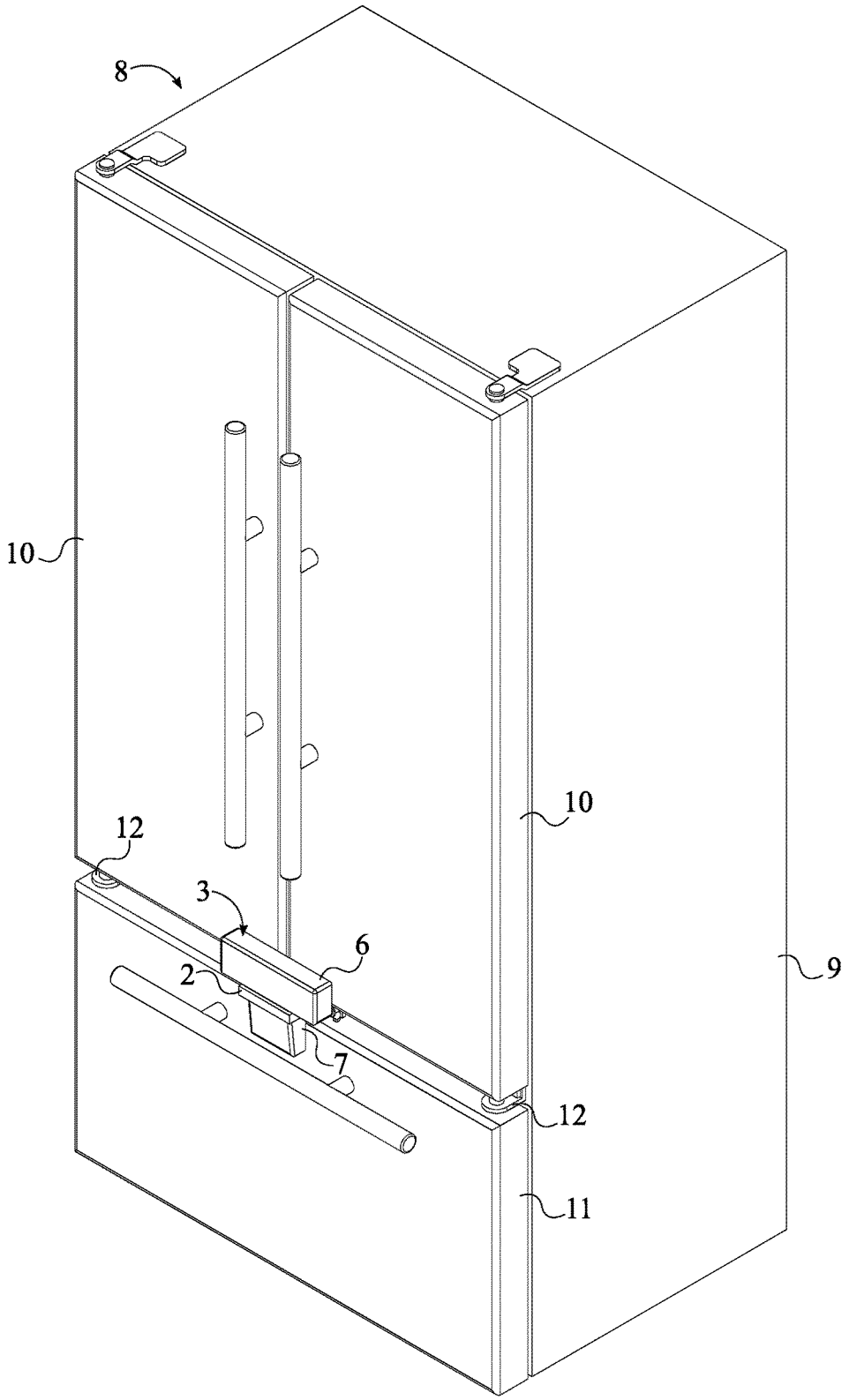
FIG. 5 is a front perspective view of the present invention with a second embodiment of the door block, wherein the second embodiment of the door block comprises a first elongated portion and a second elongated portion.
Figure 11:
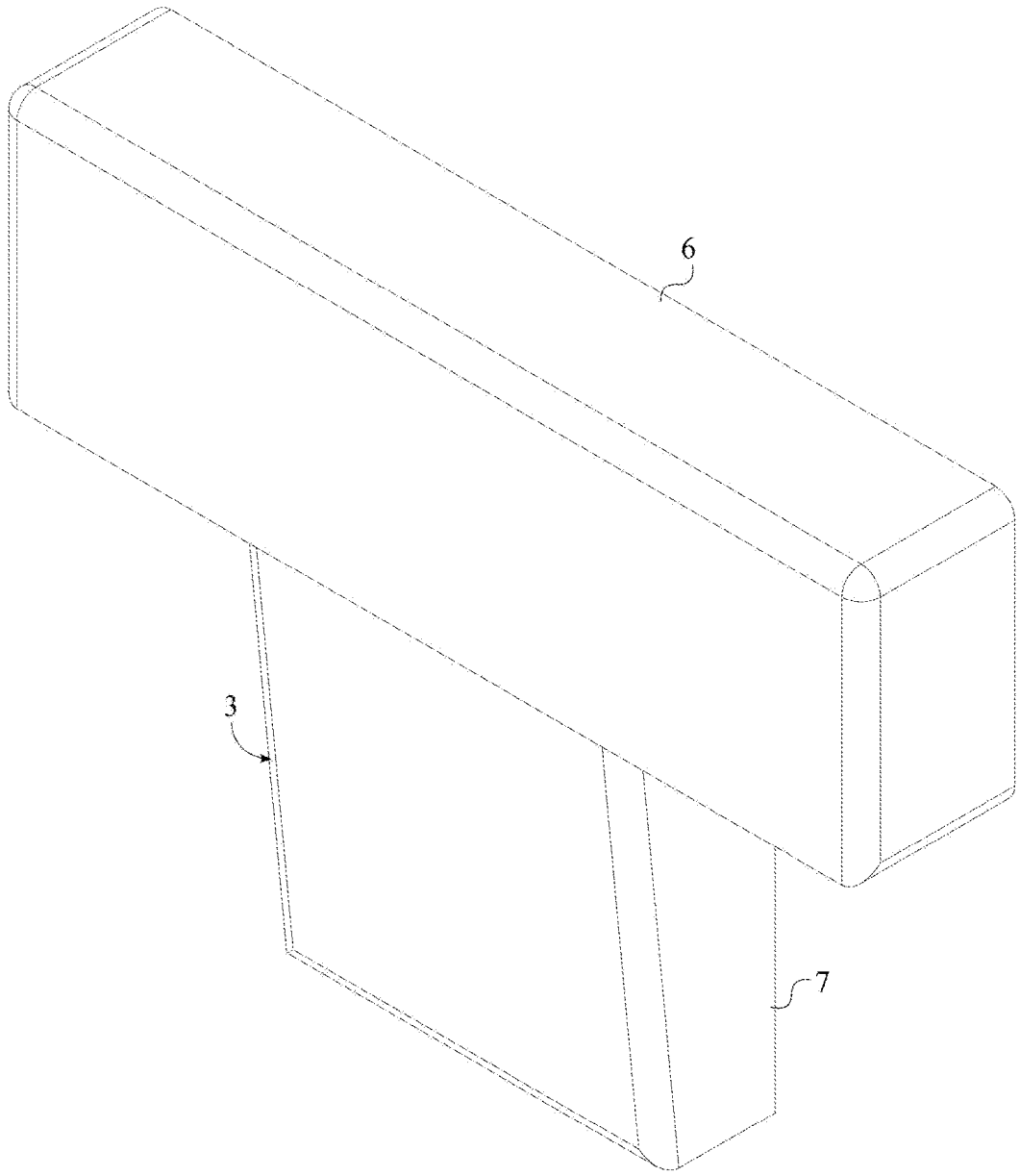
FIG. 11 is a front perspective view of the second embodiment of the door block

In reference to FIG. 5 and FIG. 11, a second embodiment of the door block 3 comprises a first elongated portion 6 and a second elongated portion 7. The first elongated portion 6 is mainly used for preventing the refrigerator door 10 from opening or closing, while the second elongated portion 7 is used for engaging with the locking bracket 2 and the freezer door 11. The first elongated portion 6 is positioned perpendicular to the second elongated portion 7. The second elongated portion 7 is centrally positioned along the first elongated portion 6. This arrangement is useful for securing the positions of the refrigerator door 10 and the freezer door 11 of a refrigerator 8 with a French door design. As seen in FIG. 4, the second elongated portion 7 engages with the locking bracket 2 and can be used to secure the freezer door 11. The first elongated portion 6 is used to secure two refrigerator doors 10 and prevents the door block 3 from sliding through the locking bracket 2.

Figure 6:
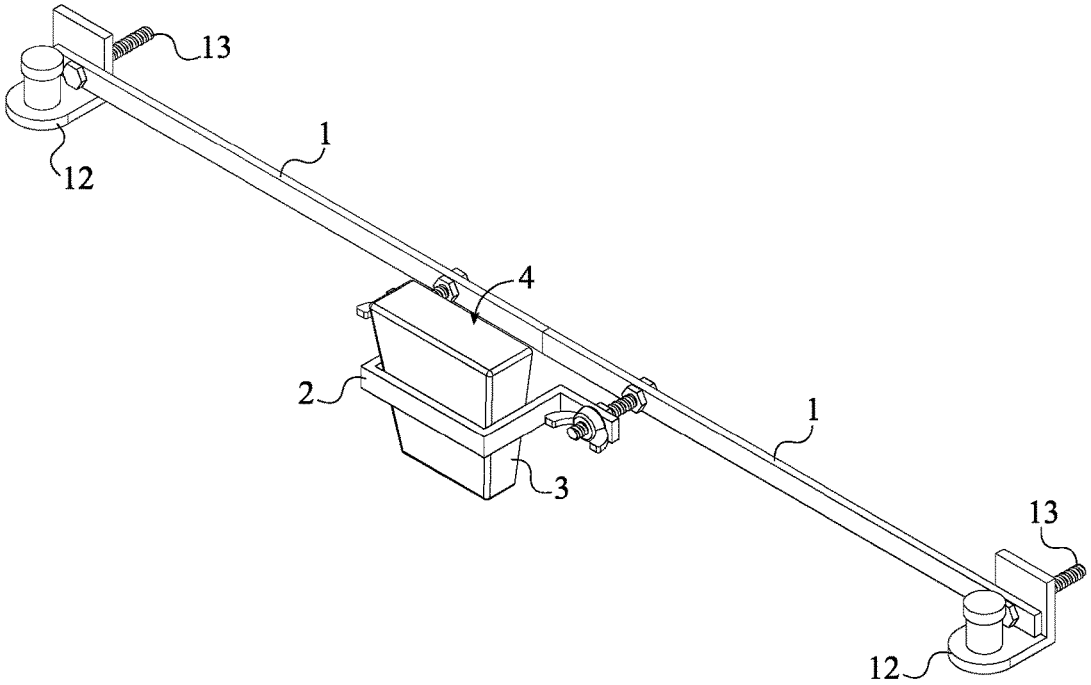
FIG. 6 is a front perspective view of the present invention, wherein the refrigerator is hidden and the at least one anchor bar is a plurality of anchor bars.

In reference to FIG. 6, in an alternative embodiment of the present invention, the at least one anchor bar 1 comprises a plurality of anchor bars 1. Each of the plurality of anchor bars 1 is used to mount the locking bracket 2 onto refrigerators 8 of different sizes. Additional anchor bars 1 may be used to accommodate for larger refrigerators 8. To do this, the plurality of anchor bars 1 is serially and collinearly positioned with each other in order to extend the effective length.

Figure 7:
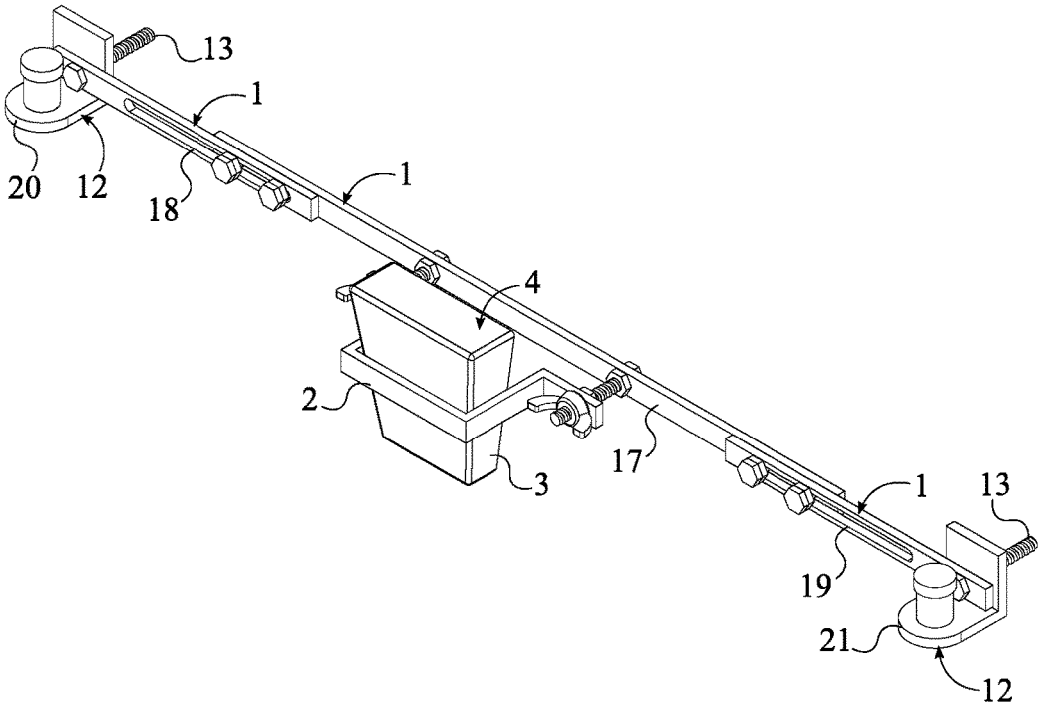
FIG. 7 is a front perspective view of the present invention, wherein the refrigerator is hidden and the at least one anchor bar comprises the central bar, the first adjusting bar, and the second adjusting bar.

In reference to FIG. 7, in another alternative embodiment of the present invention, the anchor bar 1 comprises a central bar 17, a first adjustable bar 18, and a second adjustable bar 19. Together, the central bar 17, the first adjustable bar 18, and the second adjustable bar 19 may be adjusted to accommodate refrigerators 8 of different sizes. In this embodiment, the at least one hinge bracket 12 comprises a first bracket 20 and a second bracket 21 which are positioned opposite to each other across the frame 9. The first bracket 20 is terminally mounted to the first adjustable bar 18 and the second bracket 21 is terminally mounted to the second adjustable bar 18. Together, the first adjustable bar 18 and the second adjustable bar 19 are used to secure the central bar 17 against the frame 9. The central bar 17 is slidably engaged with the first adjustable bar 18. Similarly, the central bar 17 is slidably engaged with the second adjustable bar 19. This arrangement allows the combined length of the first adjustable bar 18, the central bar 17, and the second adjustable bar 19 to be increased or decreased in order to fit onto the frame 9.

Figure 12:
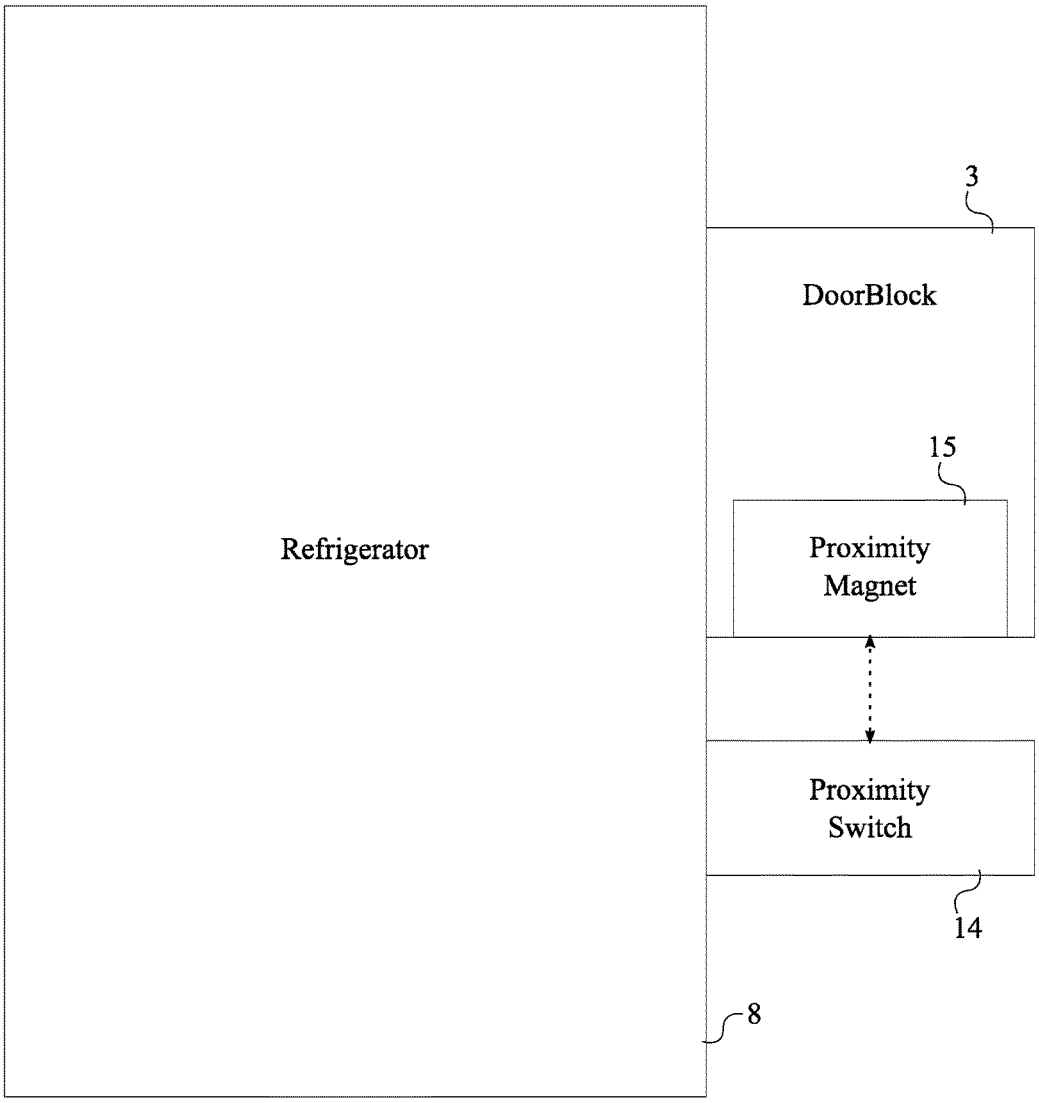
FIG. 12 is a schematic view of the present invention.

In reference to FIG. 9 and FIG. 12, the present invention further comprises a proximity switch 14 and a proximity magnet 15. The proximity switch 14 is mounted onto the refrigerator 8 and is used to alert the user if the refrigerator 8 is left open. The proximity magnet 15 is mounted onto the door block 3 and is used to signal that the refrigerator 8 is closed. The proximity switch 14 is in inductive communication with the proximity magnet 15, wherein a positioning of the proximity magnet 15 toggles the proximity switch 14. The proximity switch 14 is designed to work with an alarm which may operate on a delay. This allows for users to access the refrigerator 8 for a given amount of time before the alarm sounds. In the preferred embodiment of the present invention, the present invention further comprises a mounting magnet 16. The mounting magnet 16 is externally embedded into the door block 3 and is used to secure the door block 3 to the refrigerator 8 while food is being put into or taken out of the refrigerator 8.

Figure 8:
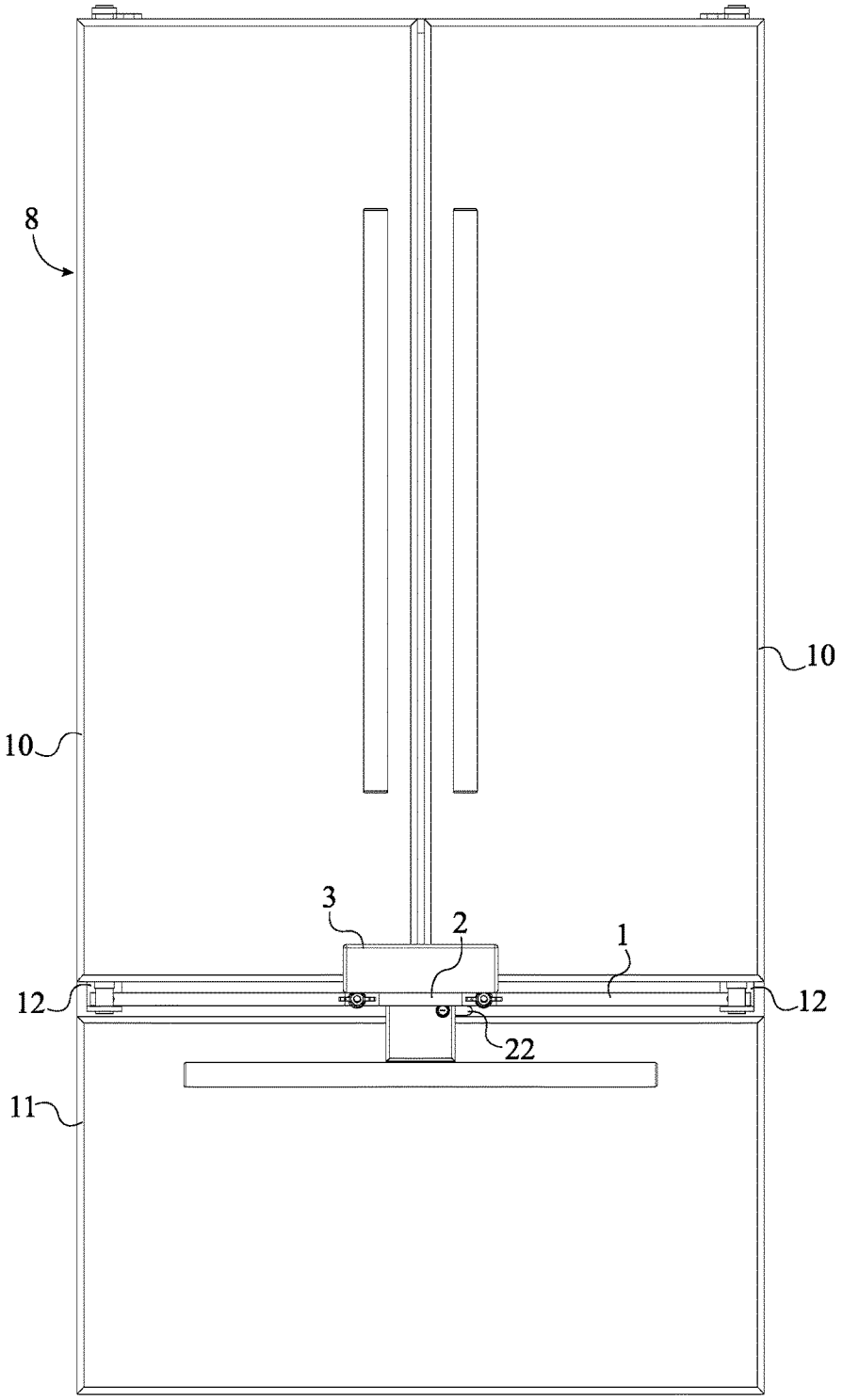
FIG. 8 is a front view of the present invention showing the block-securing mechanism coupled to the locking bracket.

In reference to FIG. 8, the present invention further comprises a block-securing mechanism 22. The block-securing mechanism 22 is used to secure the door block 3 onto the locking bracket 2. The block-securing mechanism 22 may be actuated through the use of a key, a combination lock, or various security measures. The block-securing mechanism 22 is mounted within the door block 3 and is selectively coupled to the locking bracket 2. This arrangement allows the user to further prevent unauthorized access to the refrigerator 8.

Although the invention has been explained in relation to its preferred embodiment, it is to be understood that many other possible modifications and variations can be made without departing from the spirit and scope of the invention as hereinafter claimed.

What is claimed is:

1. A refrigerator locking system comprising:

an anchor bar;

a locking bracket;

a door block;

a refrigerator;

the refrigerator comprising a frame, at least one refrigerator door and a freezer door;

the at least one refrigerator door being hingedly mounted to the frame;

the freezer door being mounted to the frame, adjacent to the at least one refrigerator door;

the anchor bar being mounted adjacent to the frame in between the at least one refrigerator door and the freezer door;

the locking bracket being connected adjacent to the anchor bar, opposite to the refrigerator;

the locking bracket being configured to be engaged by the door block;

the door block being pressed against the at least one refrigerator door and the freezer door;

the door block comprising a first end and a second end;

the door block tapering from the first end and the second end; and the locking bracket being located in between the first end and the second end in response to the locking bracket being engaged by the door block.

2. The refrigerator locking system as claimed in claim 1 comprising:

the at least one refrigerator door being pressed against the frame by the door block; and the freezer door being pressed against the frame by the door block.

3. The refrigerator locking system as claimed in claim 1 comprising:

the door block being positioned in between the at least one refrigerator door and the frame; and the door block being positioned in between the freezer door and the frame.

4. The refrigerator locking system as claimed in claim 1 comprising:

a hinge bracket;

the hinge bracket being positioned in between the frame and the at least one refrigerator door;

the hinge bracket being positioned in between the at least one refrigerator door and the freezer door; and the anchor bar being terminally mounted to the hinge bracket.

5. The refrigerator locking system as claimed in claim 4 comprising:

a mounting feature; and the mounting feature being laterally integrated through the anchor bar and the hinge bracket.

6. The refrigerator locking system as claimed in claim 4 comprising:

the anchor bar comprising a central bar, a first adjustable bar and a second adjustable bar;

the hinge bracket comprising a first bracket and a second bracket;

the first bracket and the second bracket being positioned opposite to each other across the frame;

the first bracket being terminally mounted to the first adjustable bar;

the second bracket being terminally mounted to the second adjustable bar;

the central bar being slidably engaged with the first adjustable bar; and the central bar being slidably engaged with the second adjustable bar.

7. The refrigerator locking system as claimed in claim 1 comprising:

the anchor bar comprising a plurality of sub anchor bars; and the plurality of sub anchor bars being serially and collinearly positioned with each other.

8. The refrigerator locking system as claimed in claim 1 comprising:

a block-securing mechanism;

the block-securing mechanism being mounted within the door block; and the block-securing mechanism being selectively coupled to the locking bracket.

9. The refrigerator locking system as claimed in claim 1 comprising:

a proximity switch;

a proximity magnet;

the proximity switch being mounted onto the refrigerator;

the proximity magnet being mounted onto the door block;

the proximity switch being in inductive communication with the proximity magnet; and a positioning of the proximity magnet is configured to toggle the proximity switch.

10. The refrigerator locking system as claimed in claim 1 comprising:

a mounting magnet; and the mounting magnet being externally embedded into the door block.

* * * * *